US005607262A

United States Patent [19]

Martin

[11] Patent Number: 5,607,262

[45] Date of Patent: Mar. 4, 1997

[54] RETAINING WALL BLOCK FOR USE WITH GEOGRIDS

[75] Inventor: Christopher Martin, Kent, United Kingdom

[73] Assignee: Fountain Holding Ltd., St. Helier, Jersey, Channel Islands

[21] Appl. No.: 454,344

[22] PCT Filed: Dec. 15, 1993

[86] PCT No.: PCT/GB93/02549

§ 371 Date: Aug. 3, 1995

§ 102(e) Date: Aug. 3, 1995

[87] PCT Pub. No.: WO94/13890

PCT Pub. Date: Jun. 23, 1994

[30] Foreign Application Priority Data

Dec. 15, 1992 [GB] United Kingdom ..... 9226143

[51] Int. Cl.[6] ..... F02D 29/02

[52] U.S. Cl. ..... 405/284; 405/262; 405/286

[58] Field of Search ..... 405/286, 284, 405/262; 52/740.6, 740.7

[56] References Cited

U.S. PATENT DOCUMENTS

| | | | |
|---|---|---|---|
| 2,011,531 | 8/1935 | Tranchell | 405/286 |
| 4,324,508 | 4/1982 | Hilfiker et al. | 405/289 |
| 4,616,959 | 10/1986 | Hilfiker | 405/286 |
| 4,661,023 | 4/1987 | Hilfiker | 405/286 X |
| 4,815,897 | 3/1989 | Risi et al. | 405/289 |
| 4,824,293 | 4/1989 | Brown et al. . | |
| 4,936,713 | 6/1990 | Miner | 405/286 |
| 5,044,834 | 9/1991 | Janopaul et al. . | |
| 5,064,313 | 11/1991 | Risi et al. | 405/289 |
| 5,145,288 | 1/1992 | Borcherdt . | |
| 5,417,523 | 5/1995 | Scales | 405/289 |
| 5,511,910 | 4/1996 | Scales | 405/262 |

FOREIGN PATENT DOCUMENTS

| | | | |
|---|---|---|---|
| 0002216 | 6/1979 | European Pat. Off. . | |
| 0067551 | 12/1982 | European Pat. Off. . | |
| 2924310 | 1/1980 | Germany . | |
| 1587187 | 4/1981 | United Kingdom | 405/262 |
| 91/19057 | 12/1991 | WIPO . | |

*Primary Examiner*—Tamara L. Graysay
*Assistant Examiner*—Frederick L. Lagman
*Attorney, Agent, or Firm*—Helfgott & Karas, P.C.

[57] ABSTRACT

The present invention provides a retaining wall block having means adapted to receive and retain a geogrid reinforcing material. In one aspect the receiving and retaining means comprises one or more projections (13,33) provided on a first face of the block and an aperture or recess (14,34) provided on the opposite face of the block. In a further aspect of the invention, the receiving and retaining means comprises a transverse groove (53) formed in an upper surface of the block. In a yet further aspect, the receiving and retaining means comprises comprises a transverse slot provided in the rear wall of a block, the slot comprising a groove (62,72) terminating in the body of the block in a cavity (63,73,83) of greater lateral dimension than the groove.

4 Claims, 8 Drawing Sheets

RETAINING WALL BLOCK FOR USE WITH GEOGRIDS

The present invention relates to retaining wall blocks for use with geogrid reinforcement materials.

Geogrid reinforcing materials take many forms but are typically textile netting or extruded or extended sheets of non-biodegradable material such as terylene or plastics material.

Geogrid reinforcement materials are used in civil engineering construction work such as landfill or landscaping to anchor large volumes of earth. Geogrid reinforcing materials are typically laid horizontally as the earth is being filled in layers and are spaced vertically at distances ranging from about a quarter of a metre at the bottom of an infill to about one and a half metres at the top. However, their use can be limited in certain areas of construction because of erosion by natural elements for example, sea, rain, rivers: by man-made action such as road traffic spray or by the need to restrict the batter or wall face angle due to the nature of the land use. In such situations the use of a hard face wall as part of a geogrid reinforced structure is highly desirable from functional, practical and aesthetic standpoints.

Accordingly, there is a need to provide a method of anchoring geogrid reinforcing material in a retaining wall.

WO91/19057 describes a retaining wall block having a projection formation on its upper surface for engaging a recess in a block above and for engaging an aperture cut into a geogrid material.

EP-0067551-A describes a retaining wall comprising courses of blocks, each block comprising at least one upwardly extending anchoring element over which is placed a link which has a hook by which a geogrid material is held.

U.S. Pat. No. 4,824,293 describes a retaining wall panel with a preformed channel therein communicating through a slit formed between the channel and a face of the panel. Using an enlarged rod, an edge longitudinal rib of a geogrid material can be wedged in the channel thereby holding it in place.

According to the present invention, there is provided a retaining wall block provided with means adapted to receive and retain a geogrid reinforcing material, wherein the geogrid receiving and retaining means comprises a plurality of projections provided on a first face of the block and an aperture or recess provided on the opposite face of the block; characterised in that the dimensions of each projection and the spacing between adjacent projections are selected to correspond to those of the apertures in the geogrid material such that in use, the geogrid locates over the projections with each projection mating with a corresponding aperture of the geogrid material.

Typically, a single row or a matrix of projections is provided.

Typically the projections are provided on the upper surface of one block, locating in an aperture or recess provided in the base of a vertically adjacent block.

Typically, the projections are provided further towards the rear of the block than is the aperture or recess of the block, thereby producing in an assembly of such blocks a front wall batter angle of greater than 0°.

In an alternative embodiment of the present invention the edge of a sheet of geogrid material is received in a transverse groove formed in an upper surface of a retaining wall block. To assist in retention of the geogrid material the groove is preferably provided with a rearwardly directed slope.

In an alternative arrangement of the present invention the geogrid reinforcing material receiving means comprises a groove provided in the rear wall of a block, the groove terminating in the interior of the block in a cavity of greater dimensions than the groove. Typically the groove and cavity are formed within the body of a single block. Alternatively, the groove and aperture may be formed between two vertically adjacent blocks.

Typically a clip is provided to assist in the retention of geogrid material in the cavity, the clip attaching to an edge of the geogrid thereby enlarging the dimensions of the edge such that it cannot be withdrawn from the cavity through the groove. The retaining clip may typically have the form of an elongate member having a plurality of fingers projecting from one edge thereof, the fingers being spaced to conform to the spacing of the apertures in the geogrid reinforcing material. In use, the elongate member of the clip is located over an edge of the geogrid material and a number of the fingers are bent around the edge of the geoblock material to hold the clip in position on the geogrid.

The above and other aspects of the present invention will now be described in greater detail by way of example only, with reference to the accompanying drawings, in which.

Figure 1:
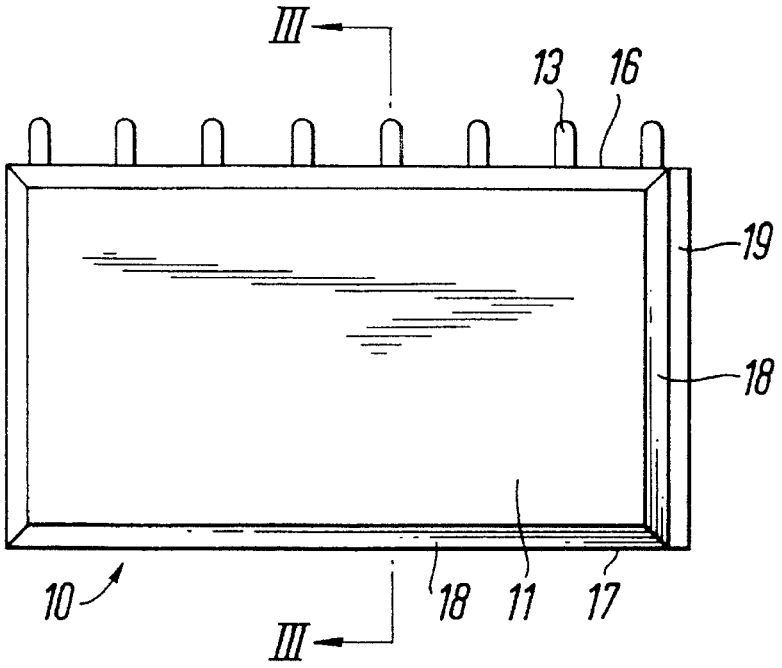
FIG. 1 is a front elevation of a first embodiment of a retaining wall block in accordance with the present invention.
Figure 2:
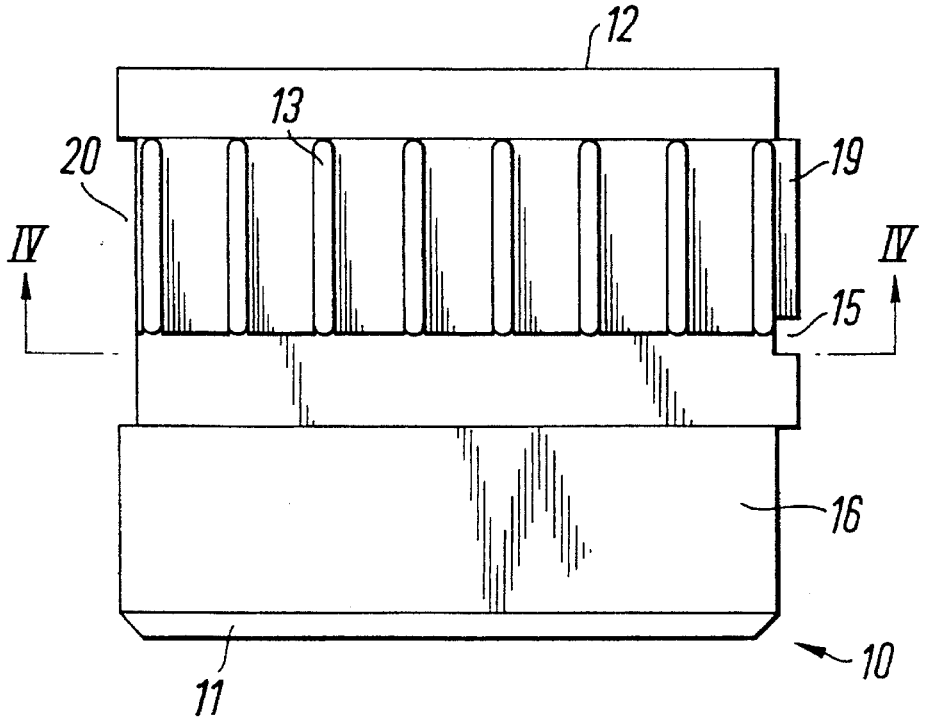
FIG. 2 is a plan view of the block of FIG. 1.
Figure 3:
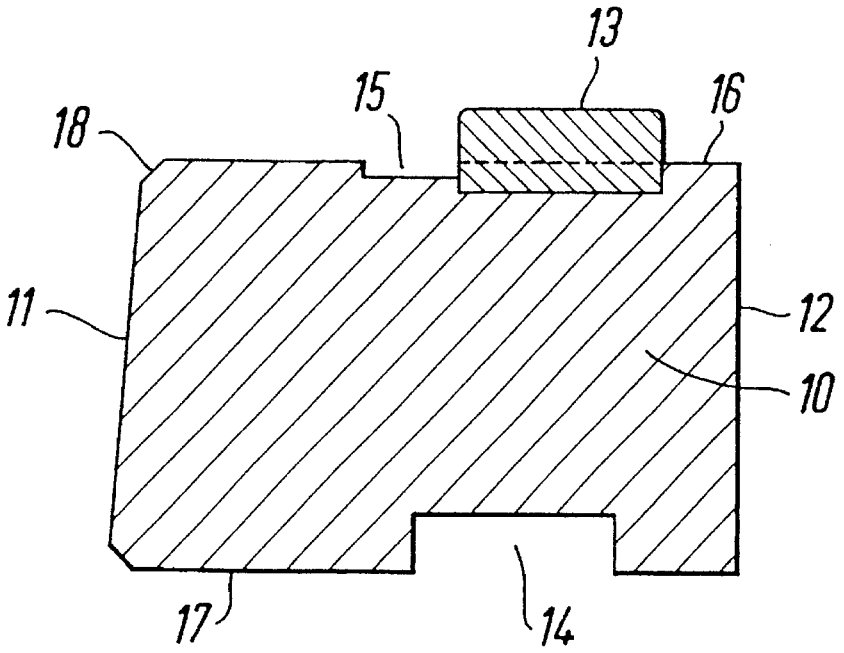
FIG. 3 is a section on the line III—III of FIG. 1.
Figure 4:
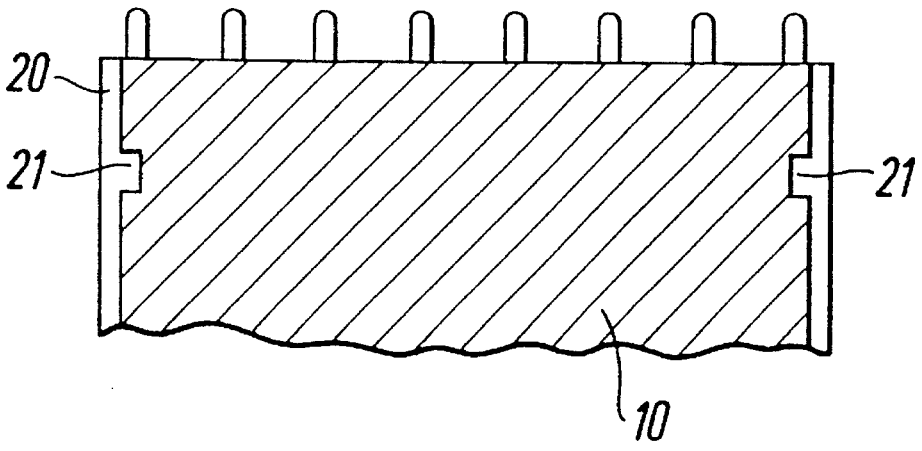
FIG. 4 is a scrap section on the line IV—IV of FIG. 2.

With reference to FIGS. 1 to 4, a wall block 10 in accordance with the present invention has a front face 11, a rear face 12 a top face 16 and a bottom face 17. In use in a retaining wall situation, the rear face 12 acts to retain the soil. On top face 16 of block 10 is provided a linear array of projections 13, each projection locating in an aperture of the geogrid material. In use, the geogrid material is placed over the projections 13 and a further block 10 is located over the first block. Projections 13 locate in a recess 14 provided on the base of the second block to thereby trap the geogrid material between the two blocks. In a typical installation several courses of blocks will be used, the geogrid material being retained by projections on adjacent blocks of a course.

In the embodiment shown in FIGS. 1 to 4, the projections 13 have a finger-like form being particularly suitable for use with geogrid materials available under the name "NETLON" (Registered Trade Mark). The size and spacing of the projections 13 along the length of the block will be determined by the particular type of "NETLON" geogrid used. In the embodiment shown in the FIGS. 1 to 4 each projection 13 is individually inserted into a cavity provided in the top of the block 10. The fingers 13 may be secured in place, or left loose whereby they will be held in position by the second block once placed on the first block As shown, projections 13 are displaced further towards the rear face 12 of the block than is recess 14. This results in subsequent courses of blocks in a retaining wall to stand back from the course below to give a batter angle typically in the order of 5°–10°. In certain construction works a batter angle of 0° may be preferred, in which case the recess 14 may be directly below projections 13. Certain constructions may additionally require the front face 11 to have a pleasing appearance or finish. In the embodiment illustrated the front face 11 is finished with a chamfered edge 18 provided around the periphery of that face.

For backfill retention of the fill and for additional rigidity of the wall, the block is provided with an interlock in the form of a tongue 19 and groove 20 each provided on one of the vertical edges of the block, the tongue 19 of one block locating in the groove 20 of a horizontally adjacent block. Further, the blocks incorporate small drainage channels 16 on the top and end faces. The dimensions of the drainage channel 15 in the top face of the block may be selected to allow for receipt of the transverse edge of the geogrid material which is typically of thicker section than that which surrounds the holes through which projections 13 locate. Certain geogrids may however be of uniform thickness in which case, the top face drainage channel may optionally be omitted. The block is also provided with lifting points 21 to assist in manual or crane manipulation of the blocks into position.

In use, the blocks are used to build a retaining wall, each block being interlocked with adjacent blocks in the same course by means of the engagement of the tongues and grooves with the corresponding features of the adjacent block. The blocks are also interlocked with blocks in the courses above and below by means of engagement between projections 13, and recesses 14 of blocks of adjacent courses. As in conventional wall construction, blocks in adjacent courses are usually staggered such that each block will be engaged with two blocks in each of the courses above and below. A geogrid reinforcing material is inserted between courses at appropriate separations.

Figure 5:
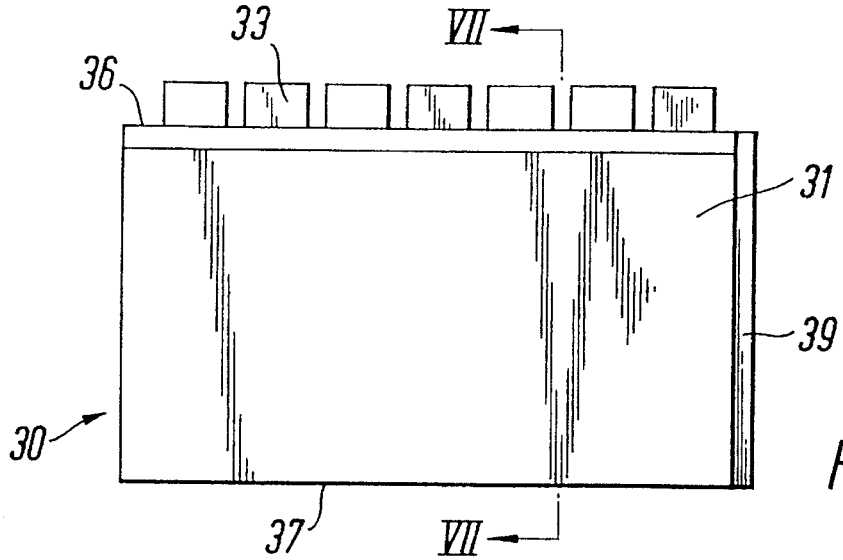
FIG. 5 is a front elevation of a second embodiment of a wall block in accordance with the present invention.
Figure 6:
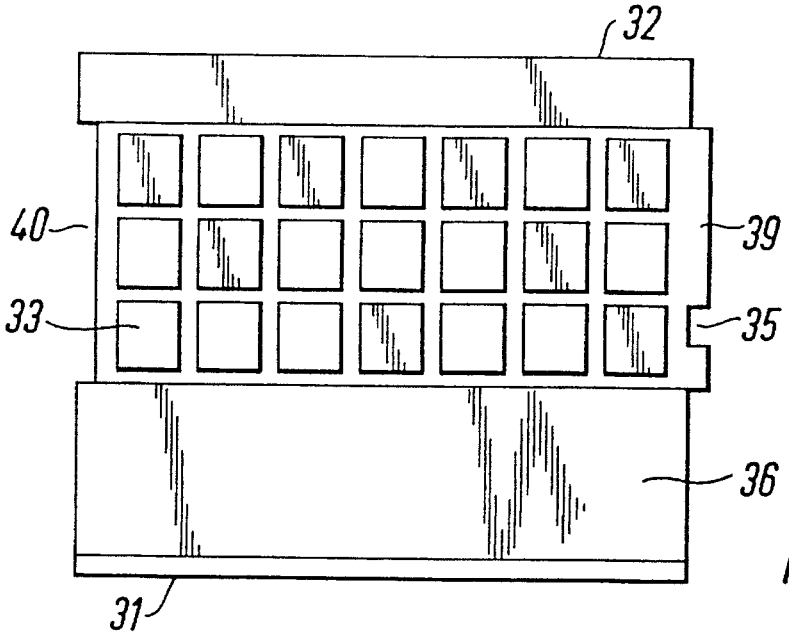
FIG. 6 is a plan view of the block of FIG. 5.
Figure 7:
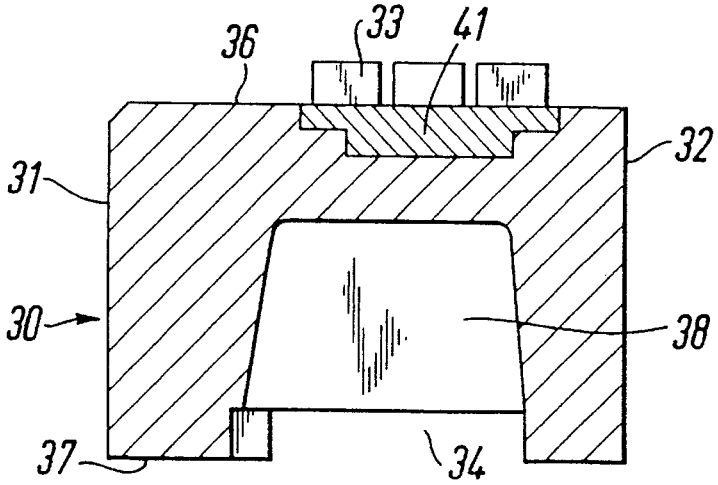
FIG. 7 is section on the line VII—VII of FIG. 5.

FIGS. 5 to 7 illustrate a generally similar block to that described above but particularly suitable for geogrids sold under the trade name "FORTRACK". Rather than finger-like projections, the square mesh of the FORTRACK type geogrid locates over the matrix of square section projections 33. In the embodiment shown the matrix of square section projections 33 is formed as a discrete element 41 which is secured, for example by a suitable adhesive, into a corresponding recess formed in the top face of the block 30. Alternatively these may be left free to slide along the recess in to which they are located. Some grids may also be wrapped around the discrete element 41 to complete their retention. The provision of the projections in a discrete element in the top surface 36 of the block 30 is equally applicable to the embodiment illustrated in FIGS. 1 to 4. It means that the body of the block 30 can be manufactured to be suitable for many situations (for example where possibly the visual appearance is the major design requirement). Such a general purpose block can then be used with many different designs of geogrid by insertion of an appropriately configured element 41.

FIGS. 5 to 7 additionally illustrate the provision of a lightening hole 38 provided in the block to reduce the weight of the block thereby making the block easier to handle. The block as shown has drainage channels 35 and tongue and groove interlock features 39, 40 substantially as described above.

In constructing a retaining wall, if a course of blocks is at a level where no geogrid material is required, projections 13 or the element 41 carrying the matrix of projections 33 can be replaced by simple keying components. Which can be provided as discrete elements or formed as an integral part of the block 10.

Figure 8:
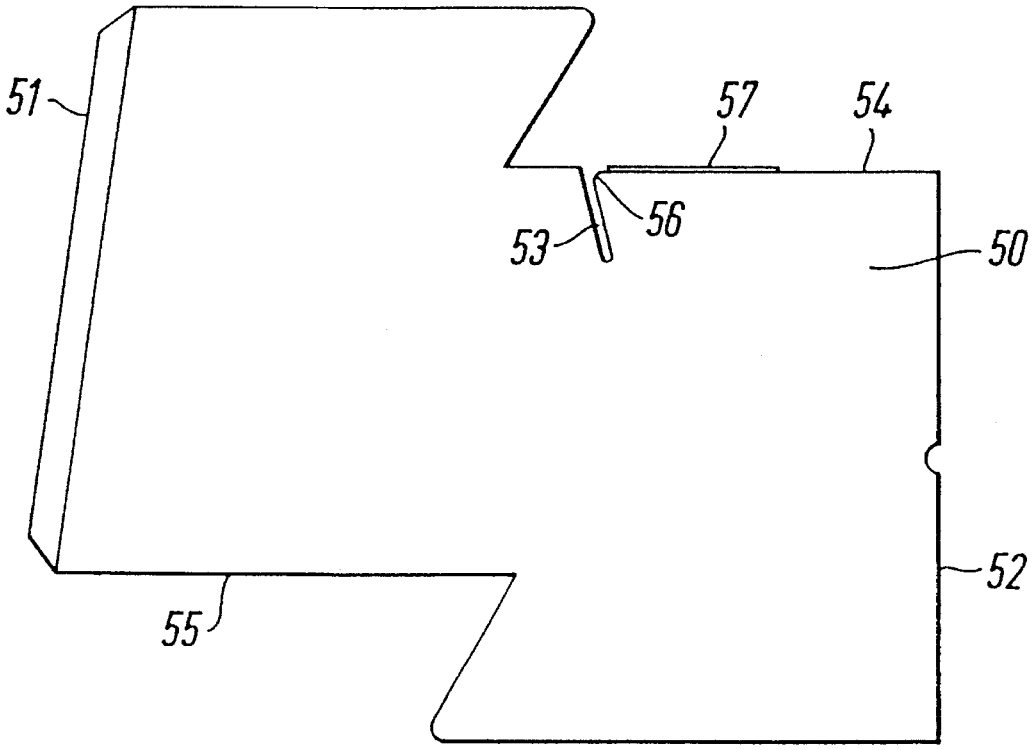
FIG. 8 is a section of a third embodiment of a wall block in accordance with the present invention.

FIG. 8, illustrates a further embodiment of a wall block 50 in accordance with the present invention having a front face 51 and a rear face 52 and being provided with a transverse groove 53 in an upper surface 54 of the block 50. The block may also include drainage channels and vertically interlocking tongue and groove locations on the vertical ends of the blocks as described above in respect of the embodiments shown in FIGS. 1 to 7.

In use, the edge of a sheet of geogrid material is located in transverse groove 53. As before, the geogrid material is secured in position by location of a further block on top of this first block. Secure retention of the geogrid material is aided by providing transverse groove 53 with a rearwardly directed incline. The width and depth of the groove are controlled such that the width accommodates the transverse ribs of the geogrid which are typically thicker than the longitudinal fingers of the geogrid. This type of block is particularly suitable for use with the geogrid sold under the registered trade mark TENSAR. A small radius on the top rear edge 56 of the groove prevents a cutting edge being formed and presented to the geogrid when put under load. As shown, the upper surface 54 and lower surface 55 are each provided with corresponding anti-rotation half-dovetail joints to provide a more rigid joint between adjacent courses of blocks. This feature may equally be applied with suitable modification to other embodiments of retaining wall blocks in accordance with the various aspects of the present invention.

To avoid the load of courses of blocks being imposed upon the geogrid, in this embodiment shallow grooves 57 are provided on the upper surface 54 of the block, a groove receiving a thin longitudinal finger of the geogrid. This provides supporting surfaces at each aperture of the geogrid on which the block above may sit without applying a compressive load to the geogrid. This feature is also applicable to other retaining wall blocks.

Under load, the combination of friction and the direction of the resolution of forces give a joint strength between block and geogrid which is stronger than the full design strength of the geogrid.

Figure 9:
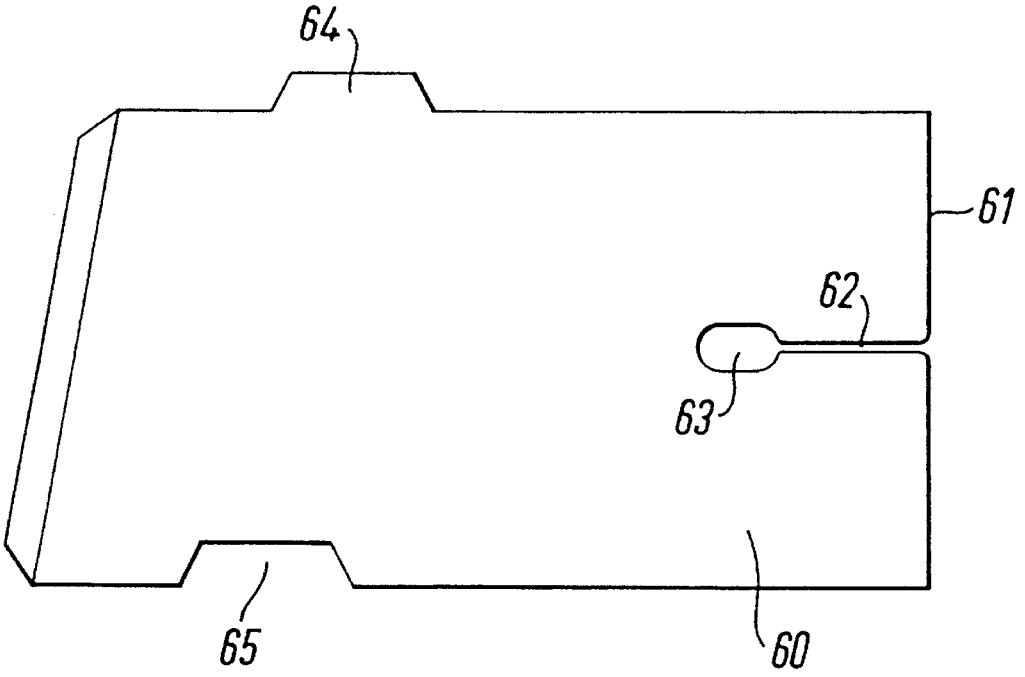
FIGS. 9 to 11 illustrate respectively first, second and third embodiments of a wall block in accordance with the alternative arrangement of the present invention.
Figure 10:
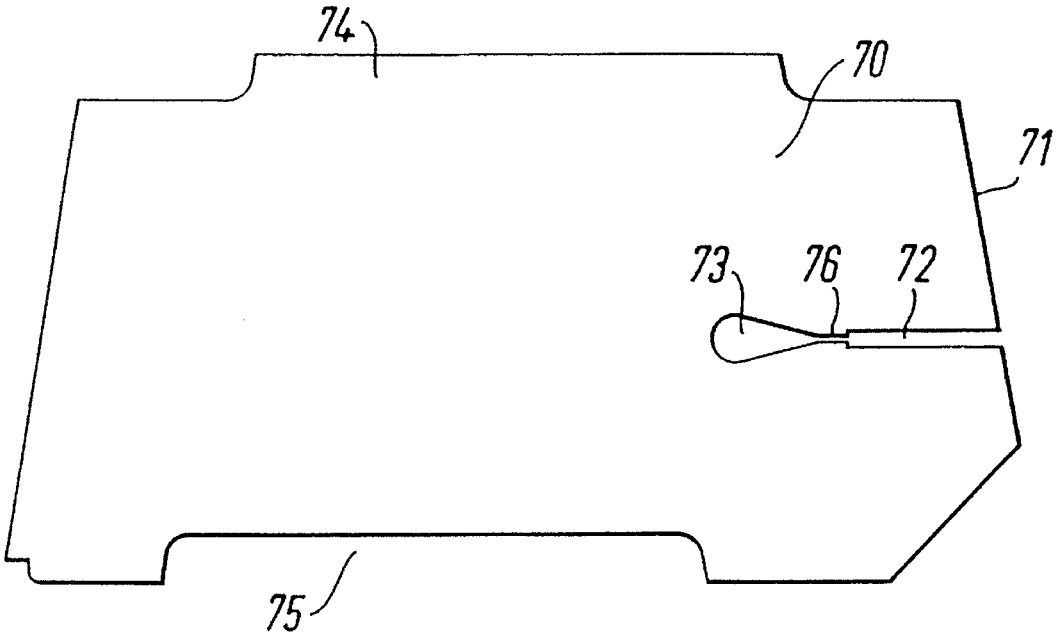

FIG. 9 illustrates an alternative arrangement of a retaining block in accordance with the present invention, the block 60 being provided in its rear face 61 with a narrow groove 62 opening out into a cavity 63 in the body of the block 60. The block 60 is further provided with a projection 64 on its upper surface which is locatable in a recess 65 in the bottom surface of a corresponding block in the course above. FIG. 10 illustrates a similar embodiment of the block 70 having in its rear face 71 a groove 72 terminating in the body of the block 70 in a cavity 73 of generally pear-shaped section; and a locating projection 74 and recess 75 provided respectively in the top and bottom surface of block. Further, in the embodiment shown in FIG. 10 groove 72 and cavity 73 are separated by a short length of a narrow slot 76. This embodiment which is illustrated in further detail in FIG. 16, has such a 'dual' slot principally for ease of moulding. The block can be moulded with a simple removable core having the form of the pear-shaped cavity and the narrow slot (the block thus manufactured having the whole shape passing through the block without a slot exiting the rear of the block). The wider groove 72 can then be created by a simple saw cut of the appropriate thickness and depth to break into the narrow slot 76. Alternatively, the groove and cavity may be formed by moulding the block around an insert or core having the shape of the features of the groove 72 cavity 73 and narrow slot 76.

Figure 11:
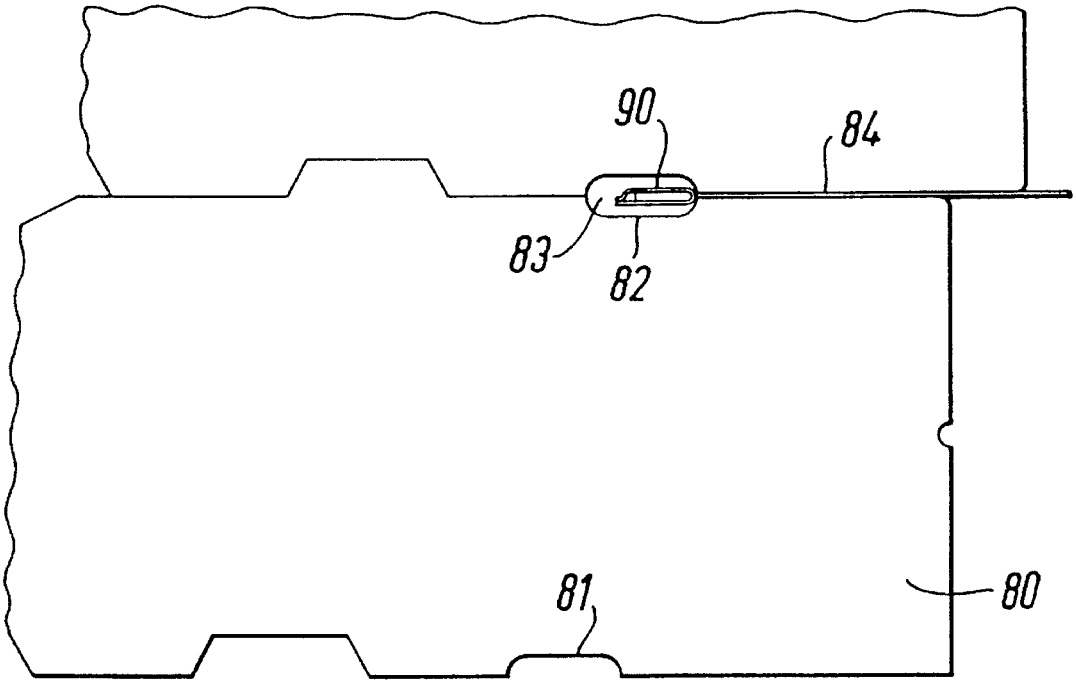

FIG. 11 illustrates a modification of this design wherein the cavity 83 is formed between channels 81, 82 provided respectively in the lower and upper surfaces of blocks 80 in adjacent courses. The corresponding groove 84 is provided in the space between the upper and lower surfaces of the blocks of the adjacent courses preferably with shallow grooves provided in either or both surfaces to receive the geogrid thereby preventing a compressive load upon the geogrid. In an alternative embodiment (not shown) cavity 83 may be formed by an enlarged channel in only one of the upper or lower surfaces of the block.

As the transverse edge of a sheet of geogrid material tends to be of thicker dimensions than the mesh area, the edge may be slid into the cavity 73, 83 and will be retained in position. Alternatively, a clip 90 as hereinafter described in further detail, may be used to increase the thickness of the edge of the geogrid material to be retained in the cavity 73, 83. Clip 90 acts to increase the differential thickness, in the case of TENSAR geogrids, of the transverse rib 95 with respect to the longitudinal fingers 96. In the case of other geogrids the clip creates a differential thickness to enable entrapment of the geogrid within the cavity which has a much narrower slot exit on the soil (rear) side of the retaining wall block through which the geogrid can exit.

Figure 12:
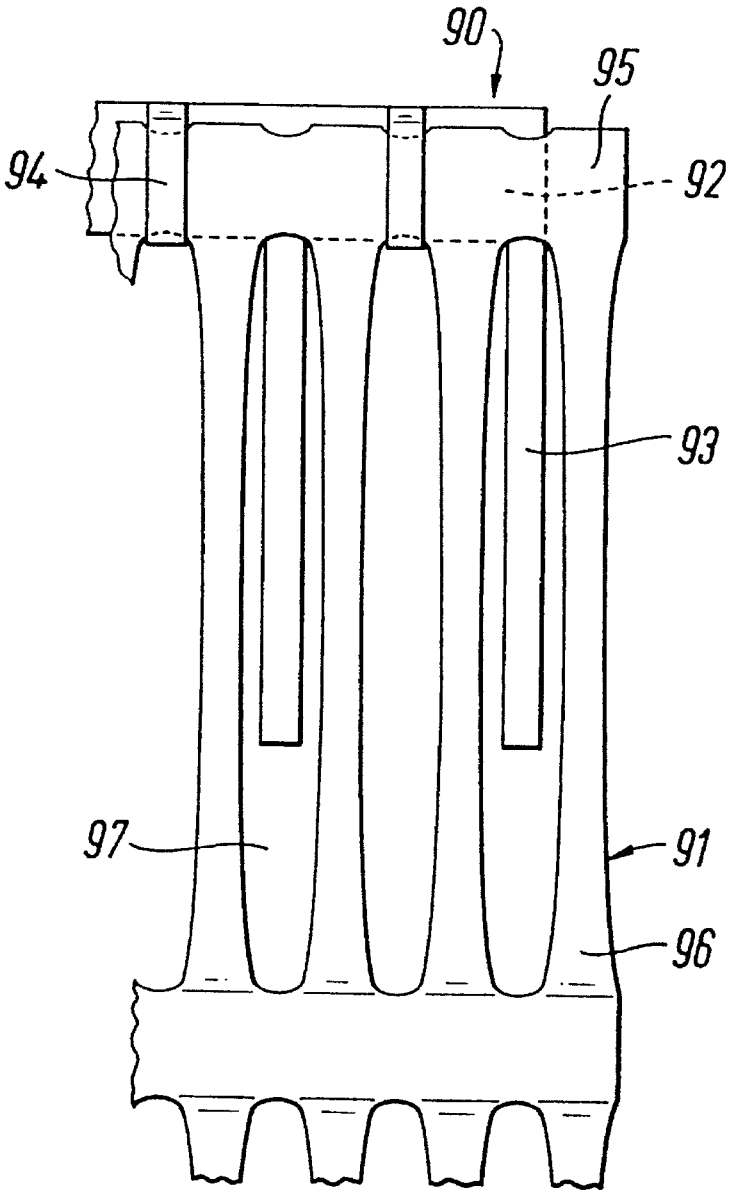
FIGS. 12 and 13 illustrate the structure and use of a clip in accordance with the present invention.
Figure 13:
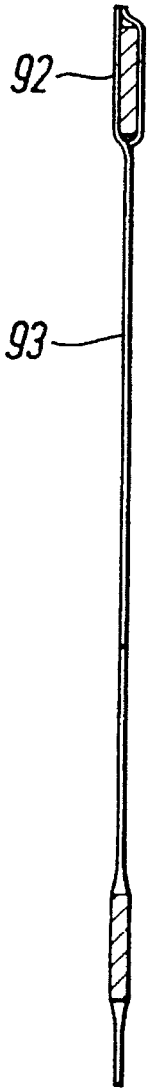

With reference to FIGS. 12 and 13, a clip 90 for this purpose comprises an elongate member 92 having planarly extending from one edge thereof, a plurality of fingers 93, 94. The separation of fingers 93, 94 will be dependent upon the separation of the apertures 97 in the geogrid material 91. In use, the clip 90, is positioned with elongate member 92 along the line of a transverse rib 95 with fingers 93,94 extending inwardly towards the body of the geogrid material, the fingers being positioned over apertures 97 in the geogrid material. A number of the fingers 94 are bent around the transverse rib 95 to crimp the clip into position on the geogrid material 91. Typically alternate fingers 94 are so bent, fingers 93 remaining extending parallel to the longitudinal fingers 96 of the geogrid material. This allows for easier handling of the geogrid material but moreover has the effect that when an upper course of blocks is placed over the clipped geogrid material, the clip is also secured between the upper and lower faces of adjacent courses of blocks. Typically, for this purposes fingers 93 are longer than fingers 94. Typically the clip is formed from a non-decomposable material, typically having a life expectancy in soil in excess of 120 years. Plastics materials, stainless steel (rustless) or bronze are suitable materials. Preferably the fingers 93 should be of greater thickness than the longitudinal fingers 96 of the geogrid material, thereby preventing compressive loads from being applied to the geogrid by a retaining wall block in the course above.

Figure 15:
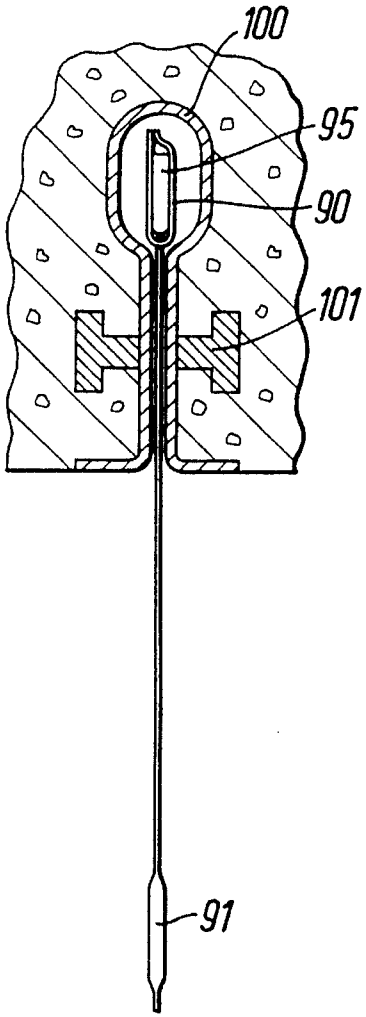
Figure 14:
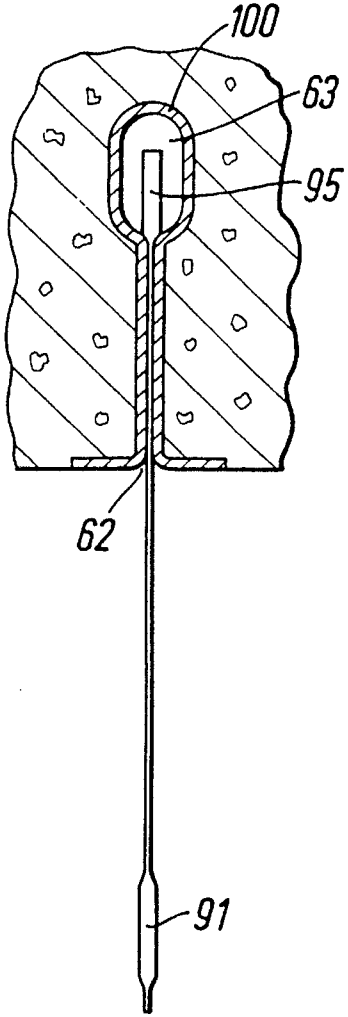
Figure 18:
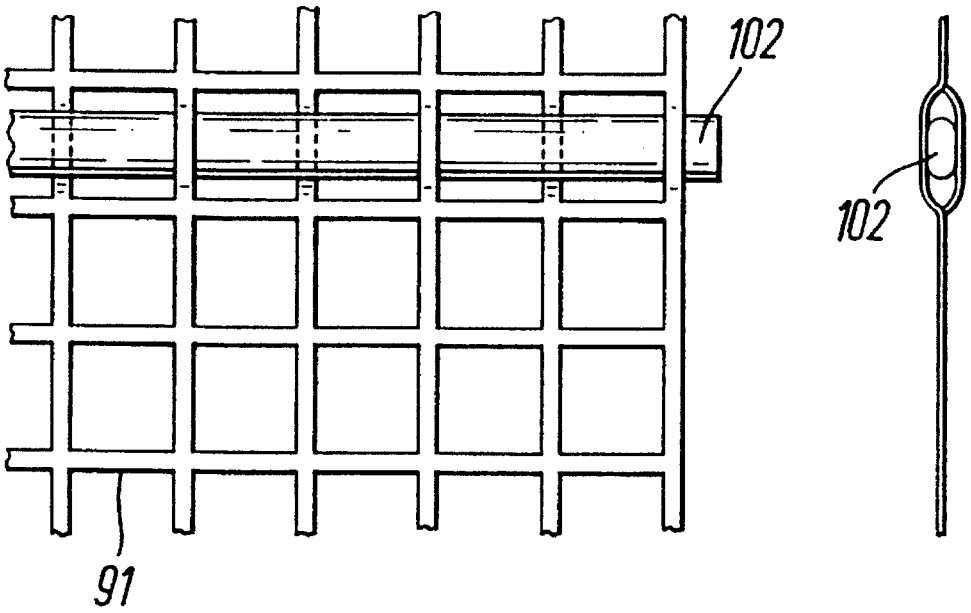
FIGS. 18 and 19 illustrate further examples of methods of retaining geogrid materials.
Figure 19:
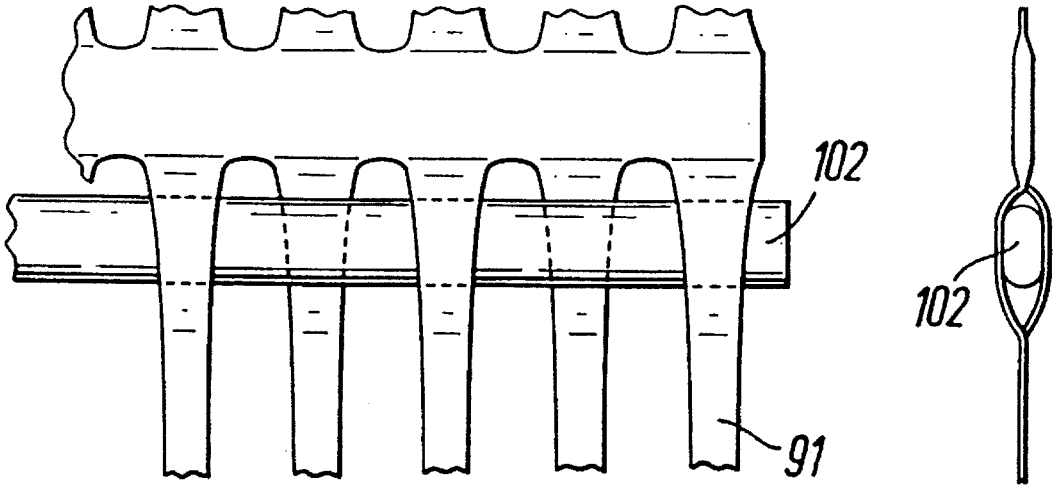

FIGS. 14 to 17 illustrate in greater detail geogrid materials embedded in the rear faces of blocks shown in FIGS. 9 to 11. FIG. 14 shows a cavity 63 and groove 62 provided with a slot liner element 100, typically metallic or of a plastics material. The liner 100 may be cast as an integral part of the block or simply slid into the block as a post production operation and may be left loose or fixed into position mechanically or with an adhesive. The liner 100 has the effect of reducing the width of groove 62 thereby strengthening the retention of the transverse rib 95 of the geogrid material 91. If a liner 100 is used, as is shown in FIG. 15, a clip 90 may also be used. In such a case, all the fingers 93, 94 may be crimped around the transverse rib 95 of the geogrid material, as the liner itself acts to protect the geogrid material from damage from the blocks. FIG. 15 further shows the use of locking tabs 101 which may be provided where the liner 100 is moulded into the block. The locking tabs have the effect of positively locking the liner 100 into to the block material.

Figure 17:
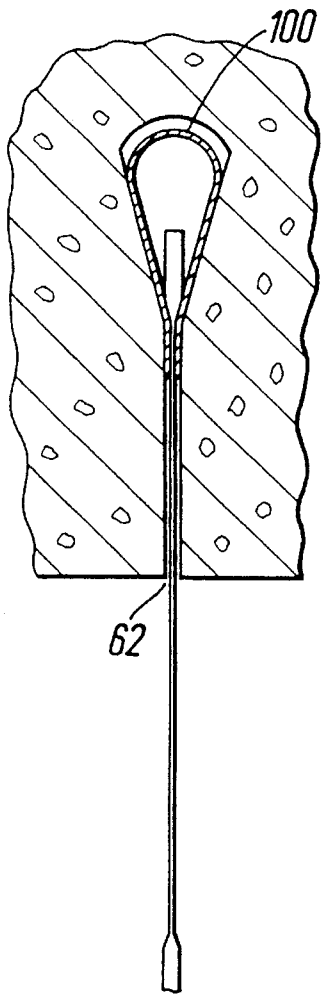
FIGS. 14 to 17 illustrate the retention of geogrid materials in retaining wall blocks in accordance with the third aspect of the present invention.
Figure 16:
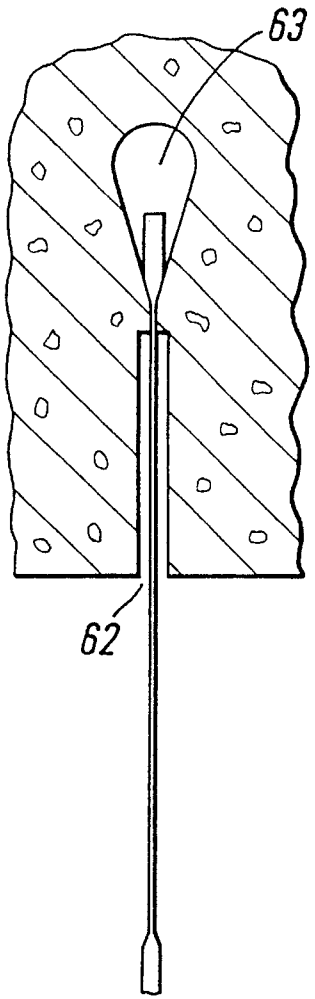

The features shown in FIGS. 16 and 17 correspond generally to the similar features described with respect to FIGS. 14 and 15 wherein the cavity 63 has the generally pear-shaped section described above.

As an alternative to using a clip 90, "TENSAR" or similar geogrids made from a weldable or mouldable material may have the end transverse rib thickened by a moulding process or by welding additional material to it. Details of the various embodiments may be altered depending upon the size and pitch of the apertures and the transverse ribs and longitudinal fingers of the particular geogrid to be used. Alternative clip configurations such as conventional wire conveyor belt clips may also be used.

The blocks are typically fabricated from concrete and may be made on vibrating presses using semi-dry material; wet cast in individual moulds or wet cast as one piece items incorporating the projections 13, 33 (in the case of the embodiments of the first aspect of the present invention). Alternative constructions may be made of clay or suitable composite material with appropriate physical and weathering properties. The front face of the blocks may be sloping or vertical as required and may be further ornamented by chamfering along certain of the edges.

Although, the embodiments of the invention described above, have been described with the projections 13, 33, 64, 74 on the upper face of each block and recesses 14, 34, 65, 75 on the lower face clearly these may be reversed within the scope of the present invention. Location of the apertures of a geogrid material over projections 13, 33 in accordance with the first aspect of the present invention and retention in this position whilst the next course of blocks is laid is however easier if these projections are provided on the upper surface of the block.

I claim:

1. A retaining wall block (10, 30, 50) comprising geogrid receiving means to receive and retain a geogrid reinforcing material (91), the receiving means comprising a plurality of projections (13,33,57) provided on a first face of the block and one of an aperture and a recess (14,34) provided on an opposite face of the block, wherein dimensions of each projection and a spacing between adjacent projections correspond to respective apertures (97) in the geogrid material (91) such that in use, the geogrid material (91) is located over the projections with each projection (13,33,57) mating with a corresponding aperture (97) of the geogrid material; the projections being provided in the form of a discrete element (41) having an element body and one or more of said projections (13,33,57) extending therefrom, the element body being mountable in a corresponding recess provided in the first face of the block, wherein the geogrid receiving means further comprises a transverse groove (53) formed in an upper surface of the block, and wherein said transverse groove (53) slopes rearwardly.

2. A method of securing a geogrid material (91) to a retaining wall made of retaining wall blocks (10,30,50) each comprising geogrid receiving means to receive and retain said geogrid reinforcing material (91), said receiving means comprising a plurality of projections (13,33,57) provided on a first face of the block and one of an aperture and a recess (14,34) provided on an opposite face of the block, wherein dimensions of each projection and a spacing between adjacent projections correspond to respective apertures (97) in the geogrid material (91) such that in use, the geogrid material (91) is located over the projections with each projection (13,33,57) mating with a corresponding aperture (97) of the geogrid material, and the projections are provided in the form of a discrete element (41) having an element body and one or more of said projections (13,33,57) extending therefrom, the element body being mountable in a corresponding recess provided in the first face of the block, the method comprising the steps of constructing a course of said blocks (10,30,50) applying along an edge of the geogrid material (91) a differential thickness increasing clip (90) having an elongate member with a plurality of fingers, positioning said elongate member (92) of the clip over the edge (95) of the geogrid material (91), and bending two or more fingers (94) of the clip around the edge of the geogrid material (91) engaging said geogrid material (97) over the geogrid receiving means; and locating a further course of said blocks upon the receiving means of said course of blocks.

3. A retaining wall comprising retaining wall blocks (60,70,80) and a geogrid material received in slots in a rear face of the wall and retained by the wall; wherein each slot comprises a groove (62,72,82) terminating within a body of the wall in a cavity (63,73,83) of a greater lateral dimension than the groove; and a differential thickness increasing clip (90) comprising an elongate element (92) having a plurality of fingers (93,94) extending planarly from one edge thereof and being applied to an edge (95) of the geogrid material (91) such that the elongate element (92) is aligned with an edge (95) of the geogrid material and two or more of the fingers (94) of the clip are bent around an adjacent rib or finger of the geogrid material.

4. A retaining wall comprising retaining wall blocks (60,70,80) and a geogrid material (91) received in slots provided at the wall and retained by the wall; wherein each slot comprises a groove (62,72,82) terminating within a body of the wall in a cavity (63,73,83) of a greater lateral dimension than the groove; and a differential thickness increasing clip (90) comprising an elongate element (92) having a plurality of fingers (93,94) extending planarly from one edge thereof and being applied to an edge (95) of the geogrid material (91) such that the elongate element (92) is aligned with the edge (95) of the geogrid material and two or more of the fingers (94) of the clip are bent around an adjacent rib or finger of the geogrid material; and wherein each slot (81,82,84) is formed between a top face of one block and a bottom face of an adjacent block.

* * * * *